US010156033B2

(12) United States Patent
Nakajima

(10) Patent No.: US 10,156,033 B2
(45) Date of Patent: Dec. 18, 2018

(54) SEWING MACHINE

(71) Applicant: JANOME SEWING MACHINE CO., LTD., Hachioji-shi, Tokyo (JP)

(72) Inventor: Makoto Nakajima, Hachioji (JP)

(73) Assignee: JANOME SEWING MACHINE CO., LTD., Hachioji-shi, Tokyo (JP)

( * ) Notice: Subject to any disclaimer, the term of this patent is extended or adjusted under 35 U.S.C. 154(b) by 62 days.

(21) Appl. No.: 15/245,186

(22) Filed: Aug. 24, 2016

(65) Prior Publication Data

US 2017/0073864 A1 Mar. 16, 2017

(30) Foreign Application Priority Data

Sep. 11, 2015 (JP) ..... 2015-179079

(51) Int. Cl.
*D05B 19/00* (2006.01)
*D05B 27/10* (2006.01)

(52) U.S. Cl.
CPC ..... *D05B 19/003* (2013.01); *D05B 19/00* (2013.01); *D05B 27/10* (2013.01)

(58) Field of Classification Search
CPC .. D05B 129/00; D05B 129/003; D05B 27/10; D05B 27/12; D05B 27/14; D05B 27/16; D05B 29/10
See application file for complete search history.

(56) References Cited

U.S. PATENT DOCUMENTS 4,887,810 A * 12/1989 Grutzmacher ..... B41F 21/12 271/112
5,186,115 A * 2/1993 Rouleau ..... D05B 35/102 112/153
7,373,891 B2 * 5/2008 Koerner ..... D05B 11/00 112/103
8,573,145 B2 * 11/2013 Dickerson ..... D05B 19/16 112/314

FOREIGN PATENT DOCUMENTS

JP 61206476 A * 9/1986
JP H05-054800 B 8/1993

* cited by examiner

*Primary Examiner* — Ismael Izaguirre
(74) *Attorney, Agent, or Firm* — Yokoi & Co., U.S.A.; Toshiyuki Yokoi

(57) ABSTRACT

The present invention provides a sewing machine that can actuary detect a physical amount of a movement of a fabric without depending on an estimated value. Thus, thread tension can be precisely adjusted. A sewing machine 1 includes a spherical body 22*a* exposed partly from a needle plate 2. The spherical body 22*a* is rotated following a feed of a fabric 100. The rotation of the spherical body 22*a* is detected by rotary encoders 22*c*, 22*d*. A physical amount of the movement of the fabric 100 is calculated based on a detection result of the rotary encoders 22*c*, 22*d*. The physical amount of the movement of the fabric 100 is, for example, a moving amount and a moving speed.

7 Claims, 15 Drawing Sheets

SEWING MACHINE

CROSS-REFERENCES TO RELATED APPLICATIONS

This patent specification is based on Japanese patent application, No. 2015-179079 filed on Sep. 11, 2015 in the Japan Patent Office, the entire contents of which are incorporated by reference herein.

BACKGROUND OF THE INVENTION

1. Field of the Invention

The present invention relates to a sewing machine adjusting thread tension.

2. Description of the Related Art

In the sewing machine, an upper thread is inserted into a needle while being guided by a thread take-up lever, and a lower thread is housed in a rotary shuttle (hook). The needle is supported by a needle bar and connected to an upper shaft, which drives the needle bar. The thread take-up lever is connected to the upper shaft. The rotary shuttle is connected to a lower shaft. The upper shaft and the lower shaft are interlockingly driven by a toothed belt. When the upper shaft is driven by a driving force of a motor or the like, the lower shaft is also rotated. Thus, the needle, the rotary shuttle and the thread take-up lever are operated while being related to each other. In the sewing machine, a thread loop is formed by the upper thread when the needle is moved to a bottom dead center and then moved upward, and the thread loop is caught by a point of the rotary shuttle. Thus, the upper thread and the lower thread are intertwined to form stitches.

In order to form the stitches appropriately by the upper thread and the lower thread, the thread tension should be properly adjusted according to a sewing condition. In a balance of the tension between the upper thread and the lower thread, if the tension of the upper thread is too strong, a confounding point of the upper thread and the lower thread is exposed to an upper surface of a fabric. On the contrary, if the tension of the lower thread is too strong, the confounding point of the upper thread and the lower thread is exposed to a lower surface of the fabric. Thus, the confounding point is not formed inside the fabric. In addition, shrinking of the fabric may occur or stitches may not become firm. The tension of the upper thread and the lower thread depends on a supplying amount of the upper thread and the lower thread.

The supplying amount of the upper thread is adjusted by supplying the upper thread, releasing the tension of the upper thread, or pulling up the upper thread by the thread take-up lever, for example. In addition, an automatic thread tensioner can be used. The supplying amount of the lower thread is adjusted by raising and lowering a lower thread feeder to which the lower thread is hooked from below so as to temporarily generate a tension on the lower thread (as shown in Patent document 1). In the above described feeding/adjusting method of the lower thread, an amount of lowering the lower thread feeder is changed depending on sewing conditions such as a sewing pattern, a feed amount of the fabric, a moving width of the needle, a kind of the fabric and a kind of the thread, for example. Thus, the supplying amount of the lower thread is adjusted according to the sewing conditions.

As for a moving amount of the fabric, a cloth feed amount adjustment lever is provided on a body of the sewing machine and a cloth feeding amount signal is input when a user performs a slide operation of the adjustment lever (as shown in Patent Document 1). The sewing machine incorporates a microcomputer to determine the supplying amount of the lower thread by using an arithmetic program while the cloth feeding amount signal input by the slide operation of the cloth feed amount adjustment lever is used as a parameter.

[Patent document 1] Japanese Examined Patent Application Publication No. H05-54800.

BRIEF SUMMARY OF THE INVENTION

The cloth feeding amount signal determined based on the slide operation of the cloth feed amount adjustment lever is merely an estimated moving amount of the fabric assuming that the sewing machine is operated precisely in an ideal state. In actual, a difference between the estimated amount and the actual amount occurs depending on the kind of the fabric and the pressure applied from the hand of the user. In such a case, when supplying the same amount of the lower thread as the moving amount of the fabric, for example, the supplying amount of the lower thread becomes excessive or insufficient with respect to the actual moving amount of the fabric. Thus, deterioration of quality of the stitches may occur.

For example, even when the fabric is set by the slide operation of the cloth feed amount adjustment lever to be moved 5 mm each time when the needle drops, the fabric may be actually moved only 4.8 to 4.9 mm in some cases if engagement between the fabric and a feed dog is not good. By the operation of the cloth feed amount adjustment lever, if the lower thread is supplied 5 mm, which is the same amount as the estimated moving amount, the lower thread is excessively supplied approximately 0.2 to 0.1 mm. If the lower thread is excessively supplied, the thread tension between the upper thread and the lower thread becomes irregular. Thus, the tension of the lower thread is weak and the stitches may be exposed on the upper surface of the fabric.

For example, even when the fabric is set by the slide operation of the cloth feed amount adjustment lever to be moved 5 mm each time when the needle drops, the fabric may be actually moved 5.1 to 5.2 mm in some cases if the fabric is strongly fed by the hand of the user. By the operation of the cloth feed amount adjustment lever, if the lower thread is supplied 5 mm, which is the same amount as the estimated moving amount, the lower thread is insufficiently supplied approximately 0.2 to 0.1 mm. If the lower thread is insufficiently supplied, the thread tension between the upper thread and the lower thread becomes irregular. Thus, the tension of the lower thread is too strong and the stitches may be exposed on the lower surface of the fabric.

In some cases, the moving speed of the fabric is variable. Representatively, there is a free motion mode. In the free motion mode, the presser foot is raised and the feed dog is lowered below a needle plate. Thus, the fabric is freely moved by the hand of the user. When the moving speed of the fabric varies as descried above, the moving amount and the moving speed of the fabric cannot be detected from the operation of the cloth feed amount adjustment lever. In such a case, the supplying amount of the lower thread cannot be adjusted depending on the moving amount and the moving speed of the fabric. Accordingly, accuracy of the thread tension is deteriorated and reliability of the quality of the stitches cannot be secured.

The present invention provides a sewing machine that can actuary detect a physical amount of the movement of the fabric without depending on the estimated value. Thus, the thread tension can be adjusted precisely.

In the present invention, a sewing machine for forming stitches on a fabric by passing a needle through the fabric to interlace an upper thread and a lower thread with each other is comprised of: a needle plate on which the fabric is placed; a spherical body that is exposed partly from the needle plate, the spherical body being rotated following a feed of the fabric; an encoder that detects a rotation of the spherical body; and a calculator that calculates a physical amount of a movement of the fabric based on a detection result of the encoder.

The sewing machine can be further comprised of: a first motor; an upper shaft that is rotated by the first motor; a lower shaft that is rotated in conjunction with the upper shaft; a thread take-up lever that receives a driving force from the first motor via the upper shaft; a needle bar that receives the driving force from the first motor via the upper shaft; a rotary shuttle that receives the driving force from the first motor via the lower shaft; a second motor that is different from the first motor; a lower thread feeder that is driven by receiving the driving force from the second motor to supply the lower thread according to a timing and an amount of driving the second motor; and a controller that drives the second motor based on the physical amount of the movement of the fabric to control a timing and an amount of supplying the lower thread of the lower thread feeder, wherein the lower thread feeder and the thread take-up lever can be separately controlled.

The calculator can calculate a moving amount or a moving speed of the fabric, and the controller can control the amount or the timing of supplying the lower thread supplied by the lower thread feeder based on the moving amount or the moving speed of the fabric.

The calculator can calculate the moving speed of the fabric, and the controller can control the timing of supplying the lower thread supplied by the lower thread feeder based on the moving speed of the fabric.

The fabric can be fed in a free motion so that the fabric is moved by a hand of a user while the feed dog is lowered below the needle plate.

The spherical body can be formed at a position of a hand of a user of pressing the fabric.

The sewing machine can be further comprised of: a feed dog that appears from the needle plate to feed the fabric in one direction; and the spherical body can be installed on a straight line, the straight line passing through a needle location point of the needle and extending in a feed direction of the fabric fed by the feed dog.

The encoder can detect the rotation of the spherical body by two axes corresponding to two oblique directions along a surface of placing the fabric.

In the present invention, a physical amount of the movement of the fabric can be actuary detected without depending on the estimated value. Thus, with respect to the thread tension, quality and reliability of the sewing can be increased.

BRIEF DESCRIPTION OF THE DRAWINGS

FIG. 1A shows an outer appearance. FIG. 1B shows an outline of an internal configuration.

FIG. 2A shows a state that the lower thread feeder is located at the uppermost point. FIG. 2B shows a state that the lower thread feeder is lowered.

DETAILED DESCRIPTION OF THE INVENTION (Entire Configuration of the Sewing Machine)

Figure 1A:
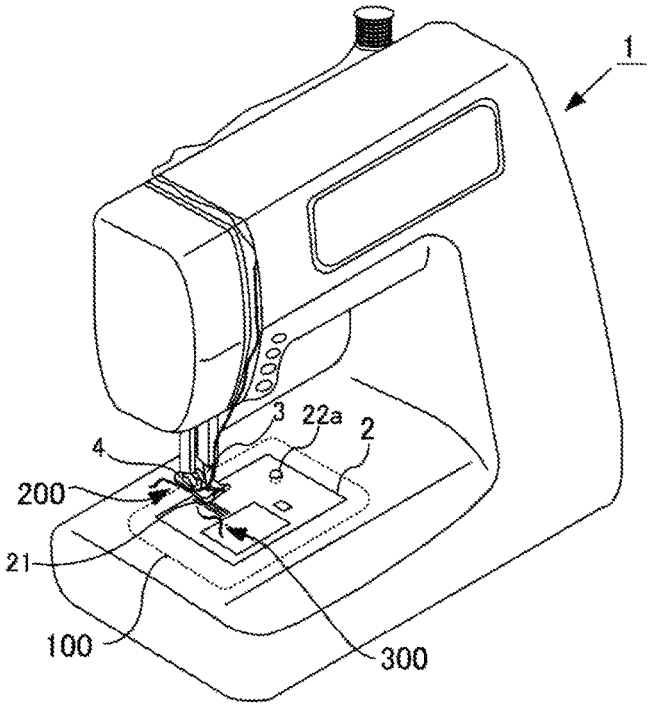
FIGS. 1A and 1B show an entire configuration of a sewing machine.
Figure 1B:
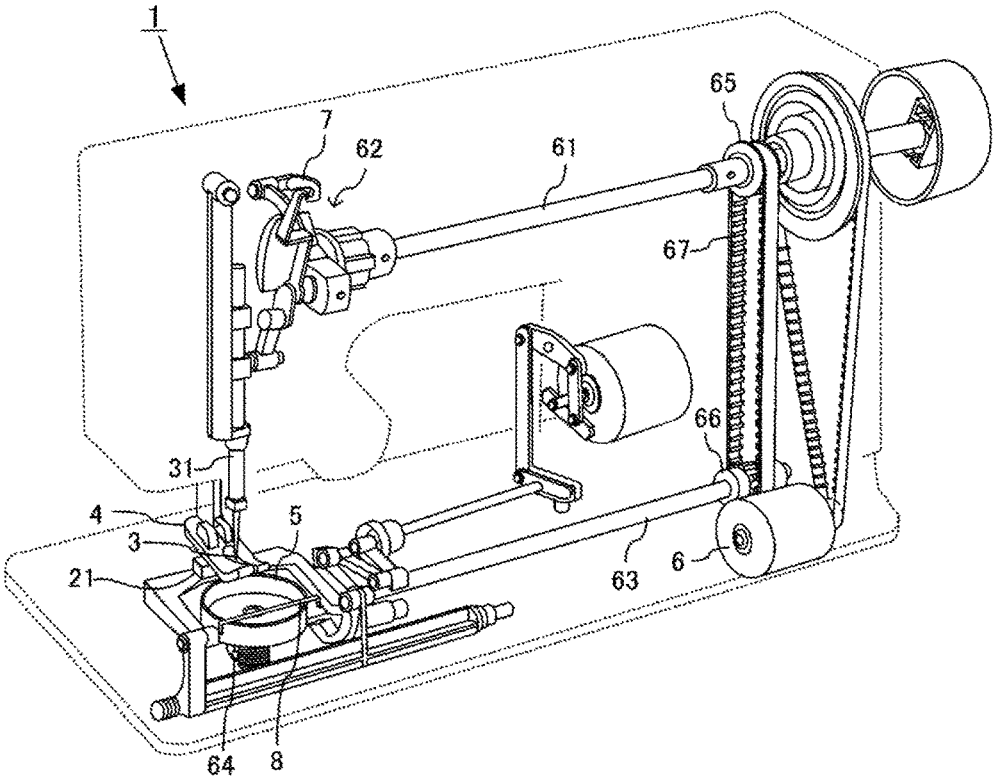

As shown in FIG. 1, a sewing machine 1 is a domestic, occupational or industrial device for sewing a fabric 100 by feeding the fabric 100 placed on a needle plate 2 using a feed dog 21 while the fabric 100 is pressed by a presser foot 4, and passing a needle 3 through the fabric 100 to interlace an upper thread 200 and a lower thread 300 supplied by a thread take-up lever 7 and a lower thread feeder 8 with each other. Thus, stitches are formed.

The sewing machine 1 includes a needle bar 31 and a rotary shuttle (hook) 5. The needle bar 31 is extended perpendicular to the needle plate 2 and can be moved vertically. A needle 3, which holds an upper thread 200, is supported by the needle bar 31 at a tip of the needle plate 2 side. The rotary shuttle 5 has a hollow drum shape opened at one of two flat surfaces. The rotary shuttle 5 is horizontally or vertically mounted on the needle plate 2 so that the rotary shuttle 5 can be rotated in a circumferential direction. The lower thread 300 is wound around a bobbin and the bobbin is housed in the rotary shuttle 5.

In the sewing machine 1, the needle 3 together with the upper thread 200 passes thorough the fabric 100 by the upward and downward movements of the needle bar 31, and an upper thread loop is formed when the needle 3 is moved upward by the friction between the fabric 100 and the upper thread 200. Then, the upper thread loop is caught by the rotating rotary shuttle 5, and the bobbin, which supplies the lower thread 300, passes through the upper thread loop in accordance with the rotation of the rotary shuttle 5. Thus, the upper thread 200 and the lower thread 300 are interlaced with each other and the stitches are formed.

The needle bar 31 and the rotary shuttle 5 use a sewing machine motor 6 as a common power source. The needle bar 31 and the rotary shuttle 5 are driven by the sewing machine motor 6 via the separately prepared transmission mechanisms. The sewing machine motor 6 corresponds to the first motor in the present invention. An upper shaft 61, which is horizontally extended, is connected to the needle bar 31 via a crank mechanism 62. The crank mechanism 62 converts the rotation of the upper shaft 61 into a linear motion and transferred to the needle bar 31. Thus, the needle bar 31 is moved upward and downward. A lower shaft 63, which is horizontally extended, is connected to the rotary shuttle 5 via a gear mechanism 64. When the rotary shuttle 5 is horizontally installed, the gear mechanism 64 can be a cylindrical worm gear with an axial angle of 90°, for example. The gear mechanism 64 converts the rotation of the lower shaft 63 at an angle of 90° and transferred to the rotary shuttle 5. Thus, the rotary shuttle 5 is horizontally rotated.

A pulley 65 having a predetermined number of teeth is provided on the upper shaft 61. A pulley 66 having the same number of teeth as the pulley 65 of the upper shaft 61 is provided on the lower shaft 63. The pulleys 65, 66 are interlockingly driven by a toothed belt 67. When the upper shaft 61 is rotated by the rotation of the sewing machine motor 6, the lower shaft 63 is rotated via the pulley 65 and the toothed belt 67. Accordingly, the needle bar 31 and the rotary shuttle 5 are synchronously operated.

The feed dog 21 is installed below the needle plate 2. The feed dog 21 is a means for transferring the fabric 100. The feed dog 21 moves in an oval shape. Thus, the feed dog 21 appears from the top surface of the needle plate 2, then moves in one direction along the top surface of the needle plate 2, and then descends below the needle plate 2. By the friction between the feed dog 21 and the fabric 100 placed on the top surface of the needle plate 2, the fabric 100 is fed following the direction of moving the feed dog 21 which appears from the needle plate 2. The feed dog 21 obtains power of moving in an oval shape from a cam mechanism 21*a* mounted on the lower shaft 63. The cam mechanism 21*a* can be formed, for example, by an egg-shaped cam fitted in the lower shaft 63 and a rocker arm, as a cam follower, having a U-shaped holding part.

A part of a spherical body 22*a* is exposed from the needle plate 2. The spherical body 22*a* can be rotated in all directions. The spherical body 22*a* is rotated following a feed of the fabric 100 to detect a physical amount of the rotation of the spherical body 22*a*. Thus, the physical amount of the movement of the fabric 100 can be detected. The spherical body 22*a* is preferably a material with a rough surface such as a rubber ball so that the friction between the spherical body 22*a* and the fabric 100 is increased and the spherical body 22*a* follows the fabric 100 preferably. The physical amount of the rotation can be a rotation amount, a rotation direction, and a rotation speed, for example. The physical amount of the feed of the fabric 100 can be a moving amount, a moving direction, and a moving speed, for example.

The thread take-up lever 7 supplies the upper thread 200 and adjusts the thread tension of the upper thread 200. The thread take-up lever 7 is rod-shaped and interposed in the middle of a thread path from a thread spool to the needle 3. A hole is formed on the tip of the thread take-up lever 7 so that the upper thread 200 is inserted into the hole. A base end of the thread take-up lever 7 is axially supported by a horizontal axis which is in parallel with the upper shaft 61. A middle part of the rod of the thread take-up lever 7 is connected to the crank mechanism 62 so that the tip of the thread take-up lever 7 is raised and lowered around the horizontal axis by the rotation of the upper shaft 61. The thread take-up lever 7 delivers the upper thread 200 from the thread spool by changing a path length of the thread path by a vertical movement. By lowering the thread take-up lever 7, the upper thread 200 is supplied with margin. By raising the thread take-up lever 7, the upper thread 200 is pulled up to tighten the stitches.

The lower thread feeder 8 supplies the lower thread 300 and adjusts the thread tension of the lower thread 300. The lower thread feeder 8 delivers the lower thread 300 by applying and releasing tension in an arbitrary timing. In an arbitrary timing, the lower thread 300 is supplied with margin to form the stitches. In an arbitrary timing, the lower thread 300 is pulled down to tighten the stitches. The lower thread feeder 8 is driven according to the physical amount of the movement of the fabric 100. The physical amount is detected from the rotation of the spherical body 22*a*.

The lower thread feeder 8 is a lever bridged to across the rotary shuttle 5. The lower thread feeder 8 is horizontally extended above the rotary shuttle 5 where the bobbin is housed. As shown in FIG. 2, a vertical position of the lower thread feeder 8 can be changed. The lower thread 300 is hooked on the lower part of the lower thread feeder 8 and extended toward an opening of the needle plate 2 installed above the lower thread feeder 8.

Figure 2A:
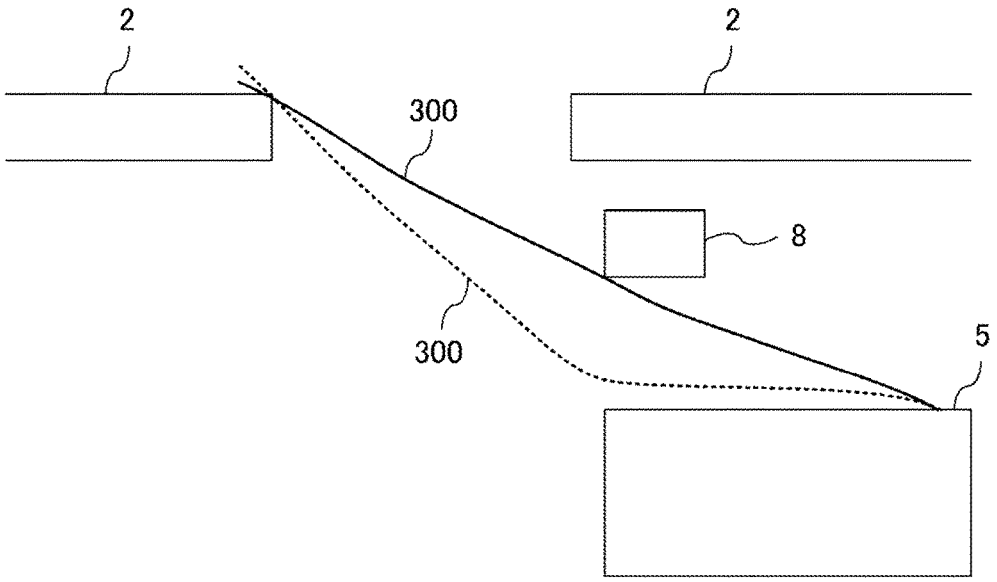
FIGS. 2A and 2B show an operation of a lower thread feeder.
Figure 2B:
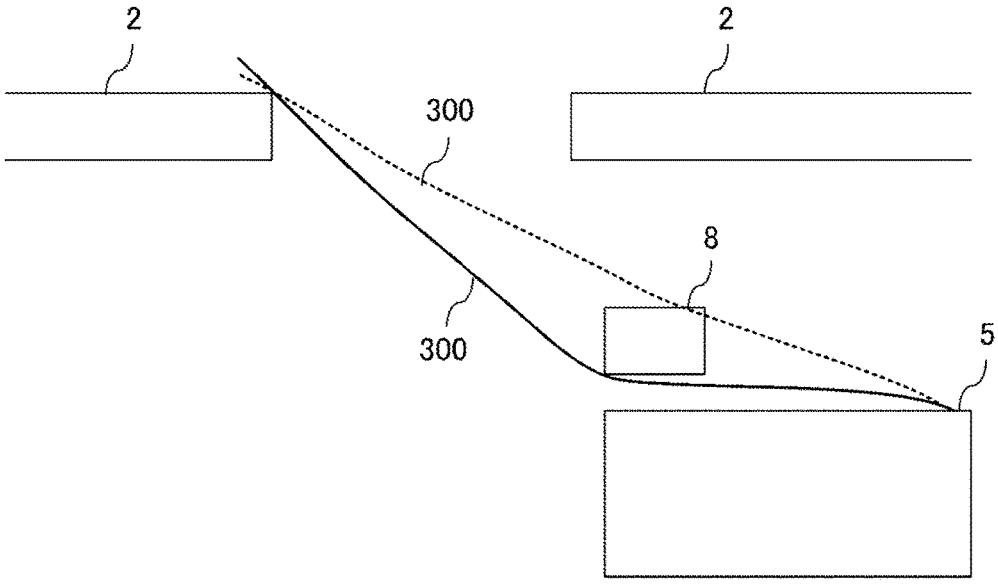

Accordingly, when the lower thread feeder 8 is lowered, the lower thread 300 is pulled down from the side of the stitches (as shown in FIG. 2B). In addition, when the lower thread feeder 8 is lowered, the path length (as shown in FIG. 2B) of the lower thread 300 is longer than the path length (as shown in FIG. 2A) where the path is linearly formed from the rotary shuttle 5 to the needle plate 2 because the lower thread 300 is pulled down and the path is bent by the lower thread feeder 8. Thus, the lower thread 300 is supplied according to the difference of the path lengths. When the lower thread feeder 8 is raised and returned to the original position, margin is formed on the lower thread 300. Thus, the lower thread 300 is supplied for forming the stitches according to the difference of the path lengths.

(Configuration of a Feed Detection Unit)

Figure 3:
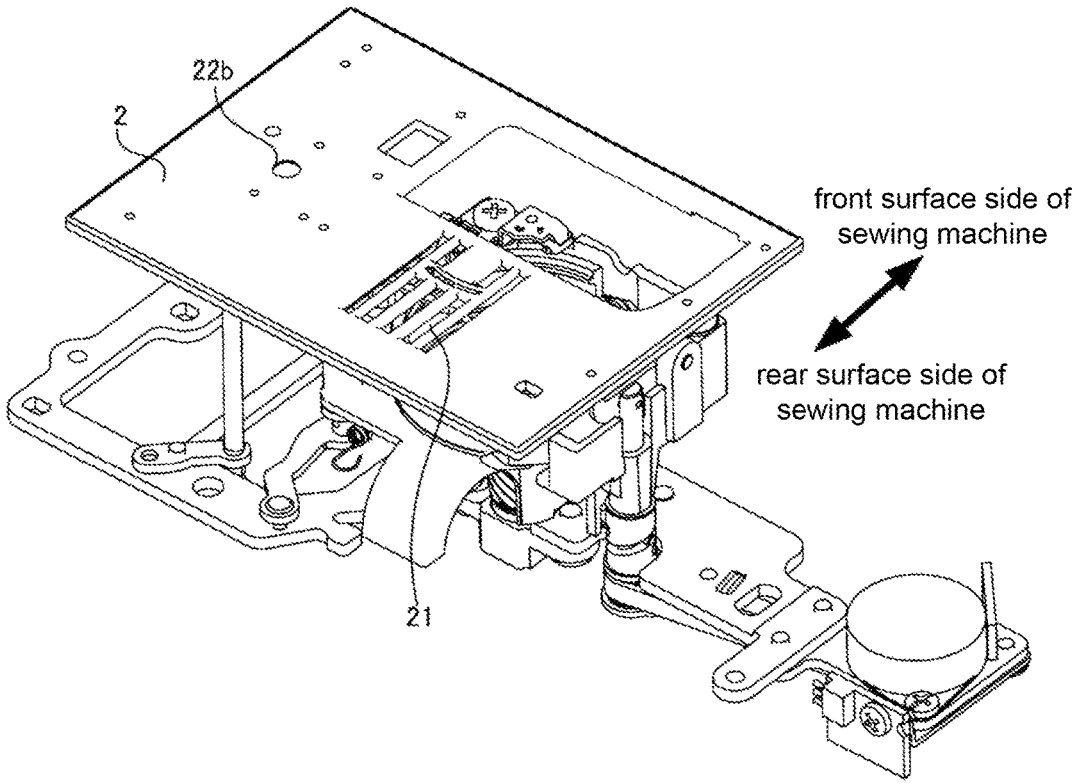
FIG. 3 is a perspective view showing an upper surface of a needle plate.
Figure 10:
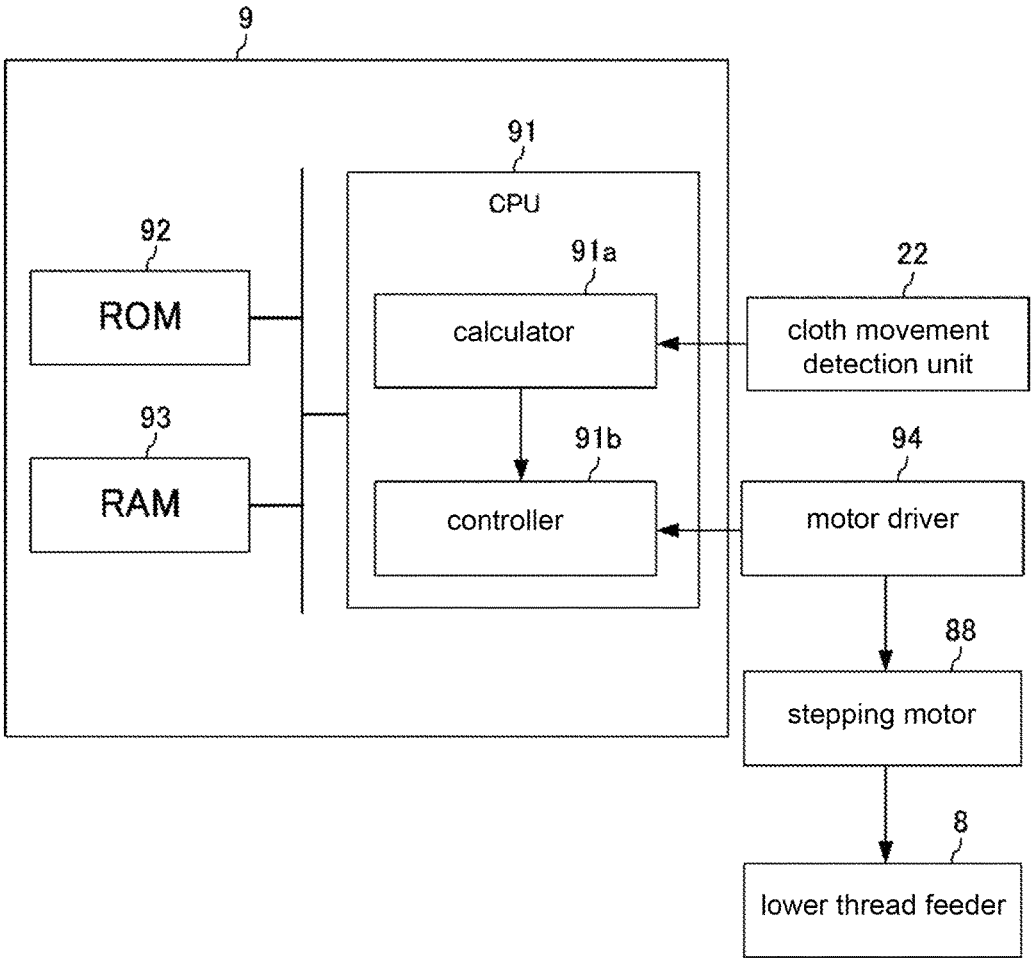
FIG. 10 is a block diagram showing a functional configuration of a computer included in the sewing machine.

FIGS. 3 to 6 show a configuration of a cloth movement detection unit 22 (as shown in FIG. 10) configured to detect a feed of the fabric 100. The cloth movement detection unit 22 includes a spherical body 22*a* as a component. FIG. 3 is a perspective view showing an upper surface of the needle plate 2. As shown in FIG. 3, a through hole 22*b* is formed on the needle plate 2. The through hole 22*b* passes through the needle plate 2 in a thickness direction. A diameter of the through hole 22*b* is smaller than a diameter of the spherical body 22*a*. The spherical body 22*a* is fit in the through hole 22*b* from a reverse side of the needle plate 2, i.e., an opposite side of the surface on which the fabric 100 is placed. A part of the spherical body 22*a* is exposed from the upper surface of the needle plate 2.

As shown in FIG. 3, the through hole 22*b* is preferably formed near the feed dog 21 and on a position where the hand of the user is placed when pressing the fabric 100. For example, the through hole 22*b* is formed at the right side of the feed dog 21 when viewed from the user so that the user can press the fabric 100 by the right hand. Thus, contact pressure between the spherical body 22*a* and the fabric 100 can be increased by the hand of the user. Accordingly, the rotation of the spherical body 22*a* can follow the movement of the fabric 100 precisely. Alternatively, the through hole 22*b* is preferably formed near the feed dog 21 and on a line extending from a needle location point of the needle 3 to a direction of feeding the fabric 100. Thus, the difference between the movement of the fabric 100 and the rotation of the spherical body 22*a* can be reduced.

Figure 4:
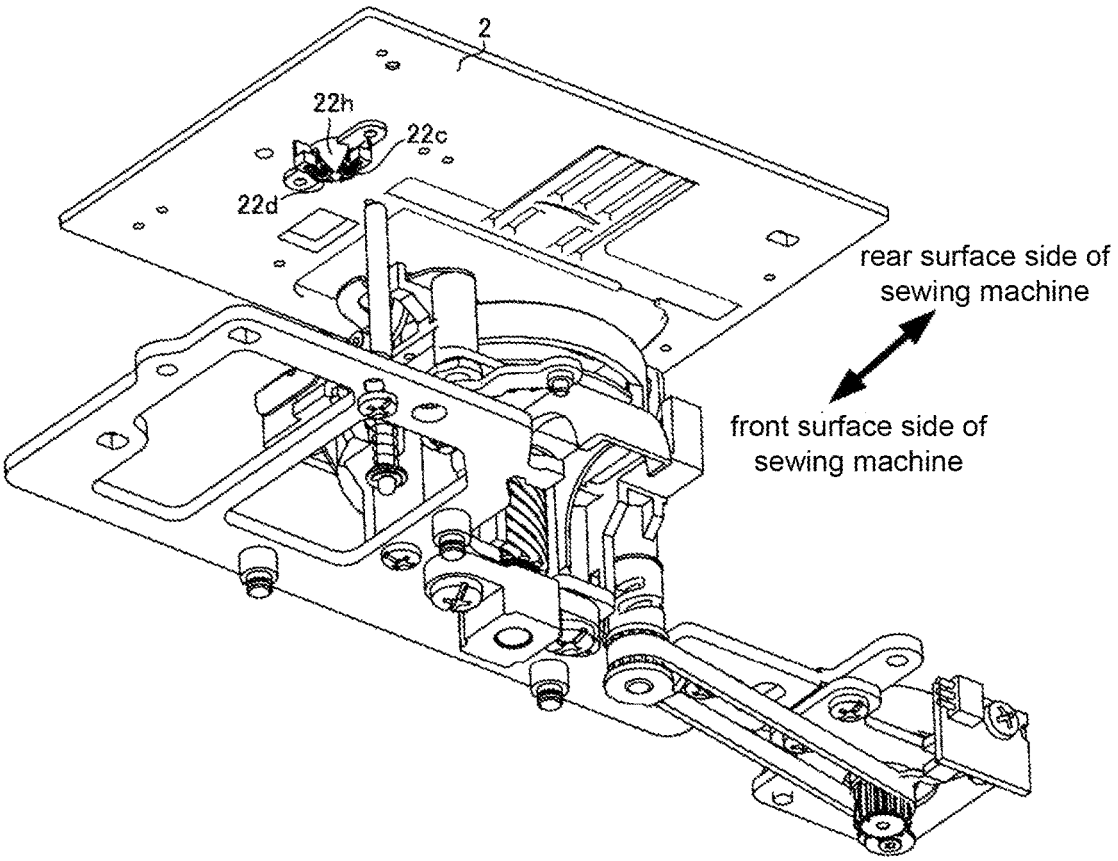
FIG. 4 is a perspective view showing a lower surface of the needle plate.

FIG. 4 is a perspective view showing a lower surface of the needle plate 2. As shown in FIG. 4, a ball receiver 22*h* is fixed on the lower surface of the needle plate 2 to support the spherical body 22*a*. The ball receiver 22*h* is formed in a bowl shape so that an edge of the bowl is aligned to an edge of the through hole 22*b*. The ball receiver 22*h* covers the through hole 22*b* from the below. An inner shape of the ball receiver 22*h* is curved so as to match the shape of the spherical body 22*a*. The ball receiver 22*h* supports the spherical body 22*a* and functions as a holder so that the spherical body 22*a* is not lowered below the needle plate 2 and the spherical body 22*a* is not idly rotated.

Figure 5:
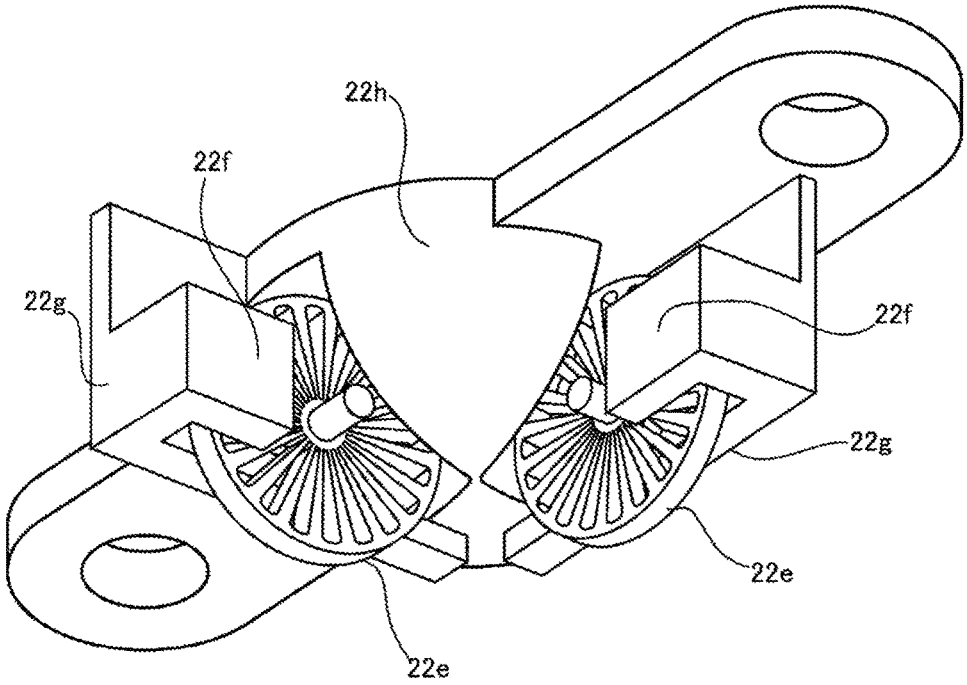
FIG. 5 is an enlarged view of the lower surface of the needle plate.
Figure 6:
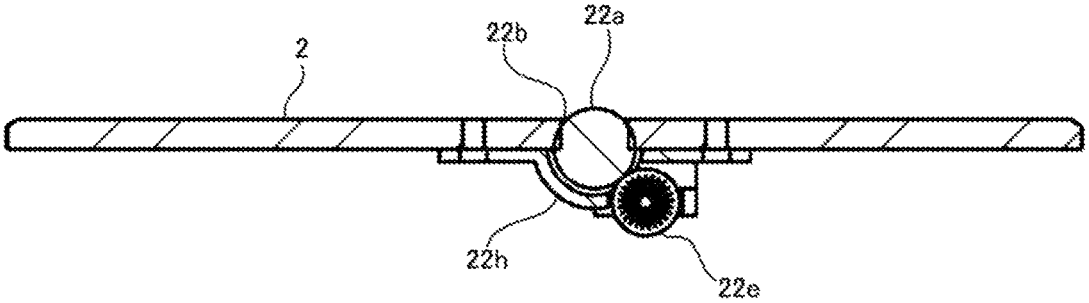
FIG. 6 is an enlarged partial cross-sectional view of the needle plate.

FIG. 5 is an enlarged view showing the lower surface of the needle plate 2. FIG. 6 is an enlarged partial cross-sectional view of the needle plate 2. As shown in FIGS. 5 and 6, on the lower surface of the needle plate 2, a rotary encoder 22*c* for detecting rotation component in an X-axis direction of the spherical body 22*a*, and a rotary encoder 22*d* for detecting rotation component of a Y-axis direction of the spherical body 22*a* are installed. The X-axis direction and the Y-axis direction are not particularly limited as long as both directions are not in parallel with each other. In order to detect the feed of the fabric 100 precisely, it is preferred that the X-axis direction is the moving direction of the feed dog 21 and the Y-axis direction is orthogonal to the X-axis direction.

Each of the rotary encoders 22*c*, 22*d* is formed by a grid disc 22*e*, a light source 22*f* and a photoelectric element 22*g*. On the grid disc 22*e*, slits are planarly formed with a constant pitch angle. The light source 22*f* and the photoelectric element 22*g* are arranged in the direction in parallel with the axis of the grid disc 22*e*. The light source 22*f* and the photoelectric element 22*g* are opposed to each other across the grid disc 22*e*. The photoelectric element 22*g* outputs a pulse signal by intermittently receiving light in accordance with the rotation of the grid disc 22*e*.

Cutouts are formed on the ball receiver 22*h* in the X-axis direction and the Y-axis direction so that the cutouts are communicated from the outside to the inside. Each of the grid discs 22*e* is inserted into the ball receiver 22*h* from the cutouts and axially supported so as to be rotatable. A peripheral surface of the grid disc 22*e* of the rotary encoder 22*c* is in contact with the spherical body 22*a* from the X-axis direction. A peripheral surface of the grid disc 22*e* of the rotary encoder 22*d* is in contact with the spherical body 22*a* from the Y-axis direction.

Namely, the rotary encoder 22*c* outputs the pulse signal in accordance with the number of pulses matching to a rotation amount of the spherical body 22*a* in the X-axis direction, and outputs the pulse signal in accordance with the number of pulses per unit time, the pulse period and the pulse width matching to the rotation speed of the spherical body 22*a* in the X-axis direction. The rotary encoder 22*d* outputs the pulse signal in accordance with the number of pulses matching to a rotation amount of the spherical body 22*a* in the Y-axis direction, and outputs the pulse signal in accordance with the number of pulses per unit time, the pulse period and the pulse width matching to the rotation speed of the spherical body 22*a* in the Y-axis direction.

(Configuration of the Lower Thread Feeder)

Figure 7:
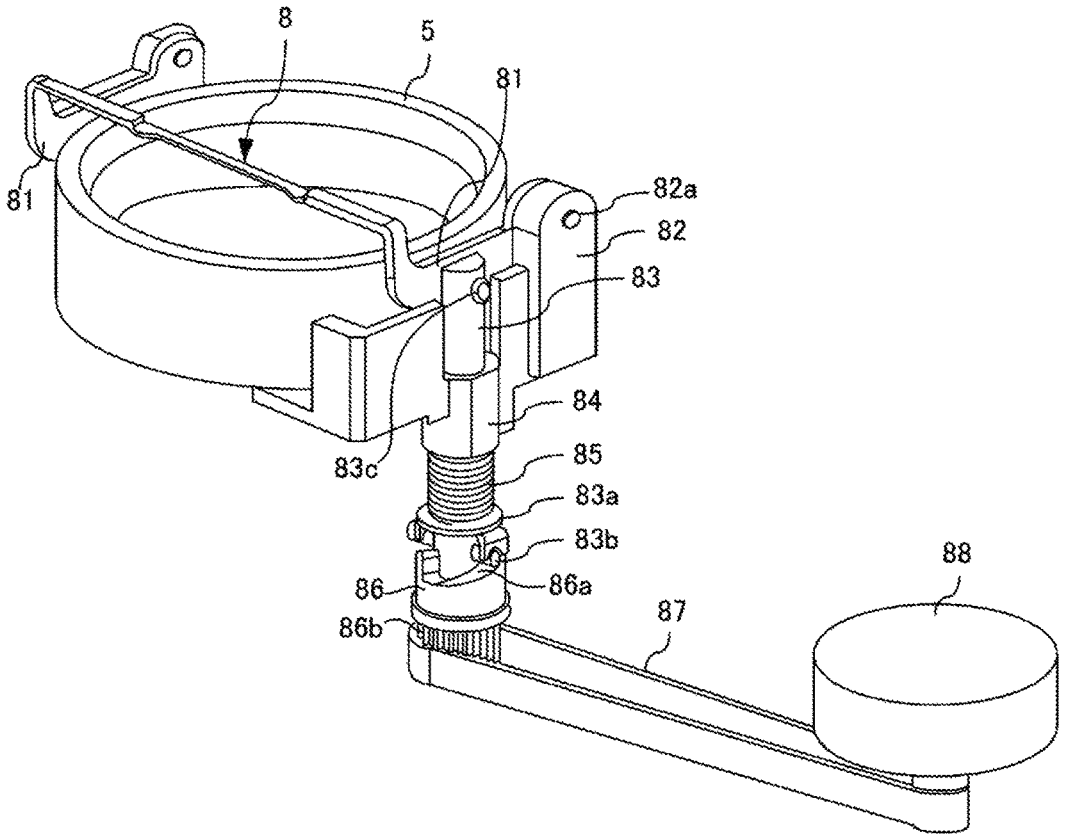
FIG. 7 is a drawing showing a detailed configuration of the lower thread feeder.
Figure 8:
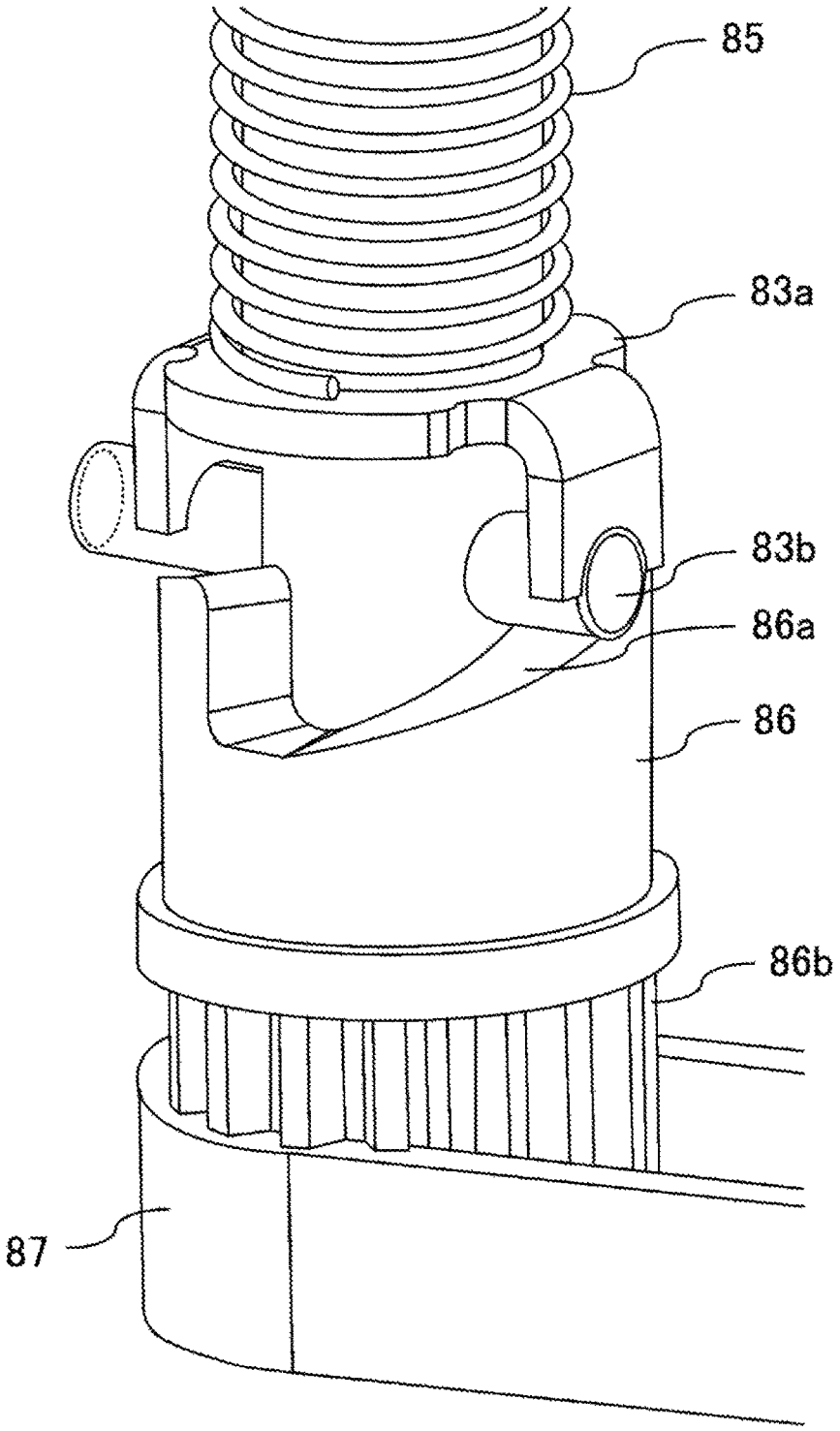
FIG. 8 is an enlarged partial view of the lower thread feeder.

FIG. 7 shows a detailed configuration of the lower thread feeder 8. FIG. 8 shows enlarged partial view of the lower thread feeder 8. As shown in FIG. 7 and FIG. 8, the lower thread feeder 8 is formed by extending both ends of a lever as arm parts 81. As a whole, the lower thread feeder 8 is U-shape as viewed from above and L-shape as viewed from the side. Namely, the lower thread feeder 8 is formed by bending downward both ends of the lever, which is bridged to across the rotary shuttle 5, and further horizontally bending both tips of the bent part.

The arm part 81 of the lower thread feeder 8 is axially supported by a support plate 82, which is fixed and serves as a fulcrum, via a pin 82*a*. In the middle of the arm part 81, a shaft 83 is connected via a pin 83*c* to serve as a power point for raising and lowering. The shaft 83 is vertically extended below from the connection part of the pin 83*c*, and fit into a bearing 84 so as to be moved upward and downward along the axis. The lower thread feeder 8, the support plate 82 and the shaft 83 are in a relationship of the third-class lever. When the shaft 83 is moved upward and downward along the axis, the lower thread feeder 8 is rotated around the pin 82*a* of the support plate 82 so as to raise and lower the lever of the lower thread feeder 8.

In a vertical movement mechanism of the shaft 83, a compression spring 85 fixed on the bottom surface of the bearing 84 is fit in the shaft 83. A flange 83*a* is extended from the lower part of the shaft 83. One end of the compression spring 85 is in contact with the shaft 83 while the flange 83*a* functions as a seat face. A push-down force is consistently applied to the shaft 83 by a biasing force of the compression spring 85 in an extending direction.

However, the position of the shaft 83 is restricted by the cam mechanism. A lowering timing and a lowerable amount of the shaft 83 is controlled by the cam mechanism. Namely, a pin 83*b* extending in a direction orthogonal to the axis passes through the lower part of the shaft 83 and projected from a circumferential surface of the shaft 83. The pin 83*b*, as a cam follower, is in contact with a cam face 86*a* located just below the pin 83*b*. Accordingly, the lowering of the shaft 83 by the compression spring 85 is restricted by the cam face 86*a*.

Figure 9:
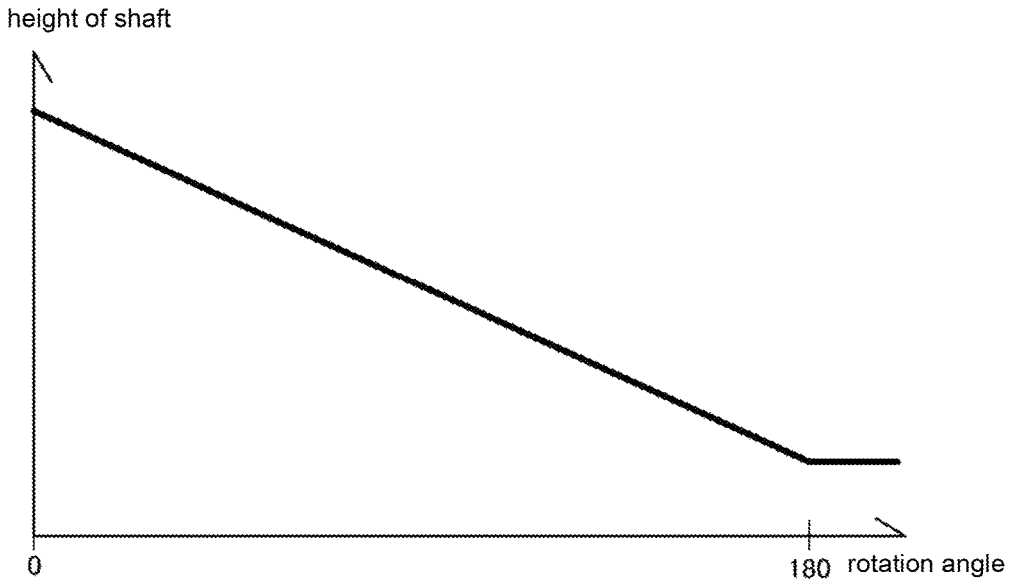
FIG. 9 is a graph showing a relation between a rotation angle of a cam surface and a height of a shaft.

FIG. 9 is a graph showing a relation between a rotation angle of the cam face 86*a* and a height of the shaft 83. The cam face 86*a* has a continuous inclination inclined downward from the highest position at 0° to 180°. In other words, the cam face 86*a* has an inclination inclined upward from the lowest position at 180° to 0°. Namely, the lowerable amount of the shaft 83 is changed depending on the position of the cam face 86*a* in contact with the pin 83*b*. Thus, the lowering amount of the lower thread feeder 8 is controlled.

In FIGS. 7 and 8, the cam face 86*a* is formed on an upper surface of a cam pulley 86 having a cylindrical shape. A pulley part 86*b* having tooth on a periphery is formed on a lower part of the cam pulley 86. The tooth are arranged along a circumferential direction of the cam pulley 86. A toothed belt 87 is wound around the pulley part 86*b*. A stepping motor 88 is provided on the sewing machine 1, separate from the sewing machine motor 6. The toothed belt 87 connects the rotation axis of the stepping motor 88 with the pulley part 86*b*. The stepping motor 88 corresponds to the second motor in the present invention.

The stepping motor 88 is driven according to the detection result of the cloth movement detection unit 22. When the stepping motor 88 is driven, the cam face 86*a* is rotated via the toothed belt 87 and the pulley part 86*b*. According to the rotation angle of the cam face 86*a*, a height of the cam face 86*a* varies and the pin 83*b* is moved following the cam face 86*a*. The compression spring 85 pushes down the shaft 83 according to the amount of the change of the height of the cam face 86*a*. When the shaft 83 is lowered, the lower thread feeder 8 connected to the shaft 83 is also lowered with the pin 82*a* of the support plate 82 as the center. When the stepping motor 88 is driven reversely, the shaft 83 is pushed up, and the lower thread feeder 8 is raised with the pin 82*a* of the support plate 82 as the center.

Because of the above described mechanism, the lower thread feeder 8 can be vertically moved in accordance with the timing of driving the stepping motor 88 without being interlocked with the driving of the sewing machine motor 6. Namely, the lower thread feeder 8 can be vertically moved in accordance with the actual moving amount of the fabric 100 without being constrained by the moving amount of the fabric 100 estimated by the feed dog 21 which is interlocked with the sewing machine motor 6. In addition, the lowering amount of the lower thread feeder 8 is restricted by the rotation amount of the stepping motor 88. In the process of lowering the lower thread feeder 8, the tension of the lower thread 300 is temporarily changed. Thus, the lower thread 300 is pulled down from the stitches or the lower thread 300 is fed out of the bobbin.

(Example of Control of the Lower Thread Feeder)

The sewing machine 1 controls the lower thread feeder 8 in consideration of the detection result of the cloth movement detection unit 22. FIG. 10 is a block diagram showing a functional configuration of a computer 9 included in the sewing machine 1. The sewing machine 1 has a CPU 91, a ROM 92, a ROM 93, and a motor driver 94 of the stepping motor 88. The motor driver 94 functions as a driving source of the lower thread feeder 8. The pulse signals of the rotary encoders 22*c*, 22*d* are input in the sewing machine 1. The CPU 91 functions as a calculator 91*a* and a controller 91*b*. The calculator 91*a* calculates the physical amount of the movement of the fabric 100 by executing the program recorded in the ROM 92. The controller 91*b* controls the lower thread feeder 8 via the motor driver 94.

The pulse signals of the rotary encoders 22*c*, 22*d* are input in the calculator 91*a*. The calculator 91*a* calculates the rotation amount and the rotation speed of the spherical body 22*a* from the number of pulses, the pulse period and the pulse width. Namely, since the rotation of the spherical body 22*a* follows the movement of the fabric 100, the calculator 91*a* calculates the moving amount and the moving speed of the fabric 100. It is also possible to calculate either of the rotation amount and the rotation speed.

Figure 11:
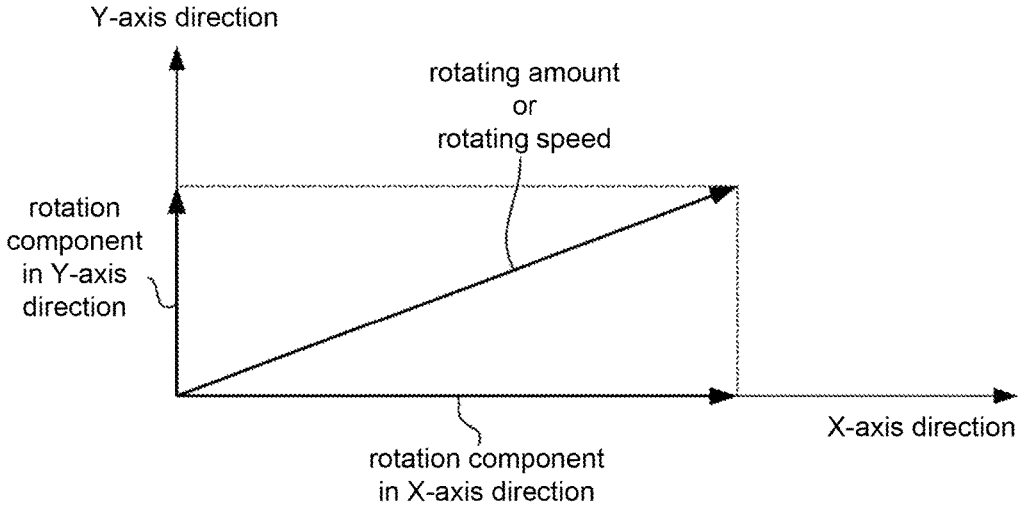
FIG. 11 is a graph showing an algorithm to calculate a physical amount of a movement of the fabric.

FIG. 11 is a graph showing an algorithm to calculate the physical amount of the movement of the fabric 100. For example, as shown in FIG. 11, the calculator 91*a* calculates a vector extended along the X-axis by converting the number of pulses of the rotary encoder 22*c*, an inverse of the pulse period of the rotary encoder 22*c*, an inverse of the pulse width of the rotary encoder 22*c*, or the rotation amount and the rotation speed of the spherical body 22*a* in the X-axis direction calculated from the above values into the length. In addition, the calculator 91*a* calculates a vector extended along the Y-axis by converting the number of pluses of the rotary encoder 22*d*, an inverse of the pulse period of the rotary encoder 22*d*, an inverse of the pulse width of the rotary encoder 22*d*, or the rotation amount and the rotation speed of the spherical body 22*a* in the Y-axis direction calculated from the above values into the length. Then, the calculator 91*a* combines the both vectors and obtains the rotation amount or the rotation speed of the spherical body 22*a* from a scalar value of the combined vector.

The controller 91*b* outputs the pulse signals for driving to the stepping motor 88 so that the stepping motor 88 is driven at an appropriate timing, driving amount and driving speed in accordance with the rotation amount or the rotation speed of the spherical body 22*a*. In other words, the controller 91*b* controls the lower thread feeder 8 to supply the lower thread 300 at an appropriate timing, supplying amount and supplying speed in accordance with the moving amount or the moving speed of the fabric 100.

Figure 12:
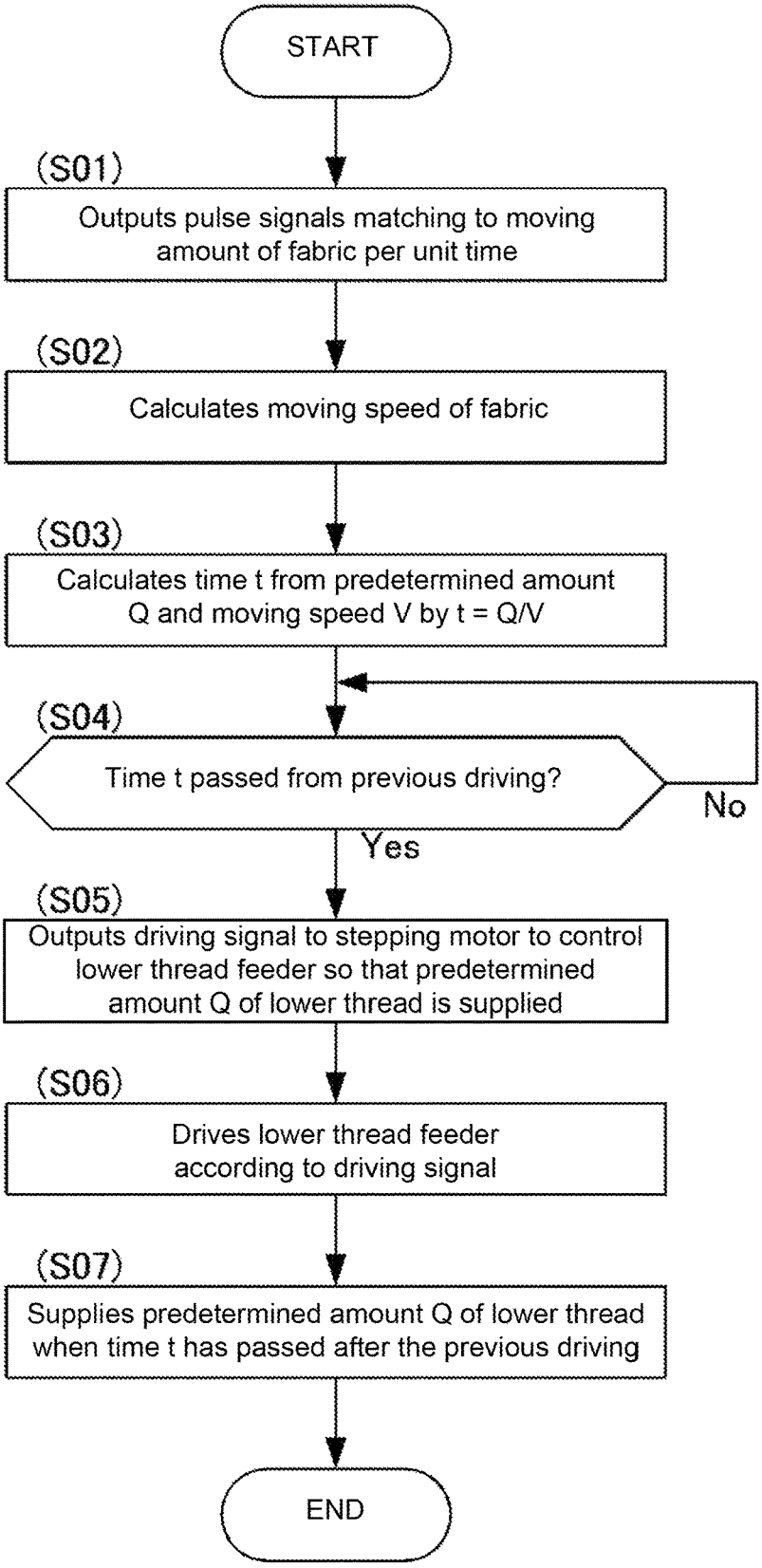
FIG. 12 is a flowchart showing a first control operation of the lower thread feeder.

Another example of controlling the lower thread feeder 8 by the controller 91*b* will be explained. FIG. 12 is a flowchart showing the control operation of the lower thread feeder 8. As shown in FIG. 12, the rotary encoder 22*c* and the rotary encoder 22*d* output pulse signals to the calculator 91*a*, the pulse signals having the number of pulses matching to the moving amount of the fabric 100 per unit time (step S01). The calculator 91*a* calculates the moving speed of the fabric 100 from the input pulse signals (step S02). The pulse width or the pulse period of the pulse signals can be also used for calculating the moving speed.

After the moving speed of the fabric 100 is calculated, the controller 91*b* determines a timing for supplying a predetermined amount of the lower thread 300. Namely, in order to supply a predetermined amount Q of the lower thread 300, if the fabric 100 is moved at a moving speed V, a time t from when the lower thread feeder 8 is previously driven to when a moving amount V×t reaches the predetermined amount Q is t=Q/V.

Accordingly, the controller 91*b* calculates the time t from the predetermined amount Q and the moving speed V (step S03), and begins to measure the time from when the lower thread feeder 8 is previously driven (step S04). When the time t=Q/V has passed (step S04, Yes), the controller 91*b* outputs the driving signal to the stepping motor 88 to control the lower thread feeder 8 so that the predetermined amount Q of the lower thread 300 is supplied (step S05). The stepping motor 88 drives the lower thread feeder 8 according to the driving signal (step S06). The lower thread feeder 8 supplies the predetermined amount Q of the lower thread 300 when t=Q/V has passed after the lower thread feeder 8 is previously driven (step S07). The predetermined amount Q is same amount as the moving amount of the fabric 100.

(Operations)

Figure 13:
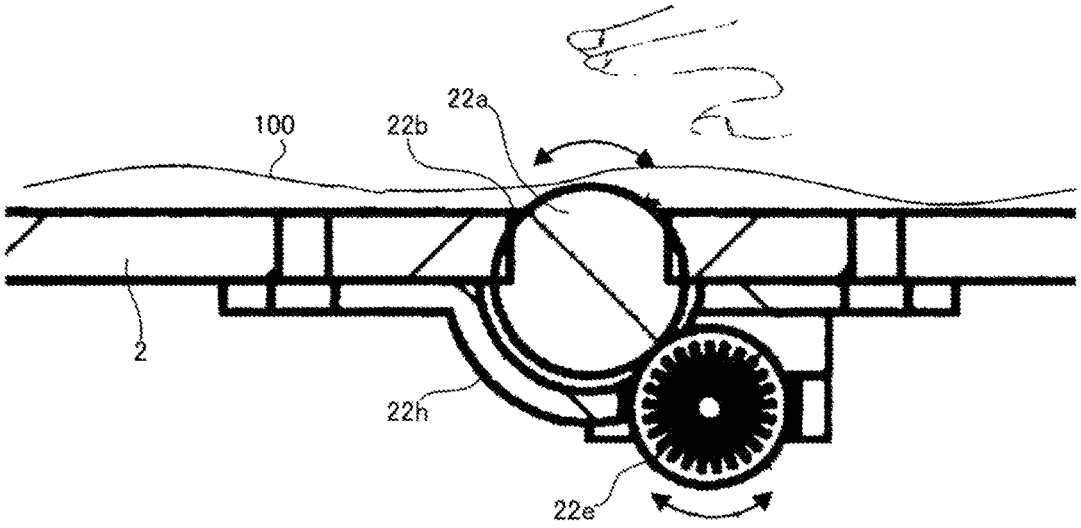
FIG. 13 is a schematic diagram showing a rotation of a spherical body of a cloth movement detection unit.

As shown in FIG. 13, the fabric 100 is covered on the spherical body 22*a* and the spherical body 22*a* is exposed at a position of a hand of a user of pressing the fabric 100. When the fabric 100 is moved while being guided by the feed dog 21, the spherical body 22*a* rotates at the rotating speed and the rotating amount same as the moving speed and the moving amount of the fabric 100 by the friction force applied between the fabric 100 and the spherical body 22*a*. When the spherical body 22*a* is exposed at a position of a hand of a user, contact pressure between the fabric 100 and the spherical body 22*a* is increased by the hand of the user. Thus, the rotation of the spherical body 22*a* follows the movement of the fabric 100 preferably.

Although the fabric 100 is moved mainly in the feeding direction of the feed dog 21, moving component is also generated in the direction orthogonal to the feeding direction by crease of the fabric 100 and friction of the material. The cloth movement detection unit 22 detects the component in the feeding direction of the fabric 100 and the orthogonal direction by the biaxial rotary encoders 22*c*, 22*d*. Thus, the moving amount and the moving speed of the fabric 100 can be detected regardless of the moving direction of the fabric 100.

For example, the sewing machine 1 is operated in the free motion mode. In the free motion mode, the presser foot 4 is lifted up so as not to be in contact with the fabric 100. The feed dog 21 is lowered from the needle plate 2 so as not to be in contact with the fabric 100 consistently. The moving speed and the moving direction of the fabric 100 are freely changed by the hand of the user.

Figure 14:
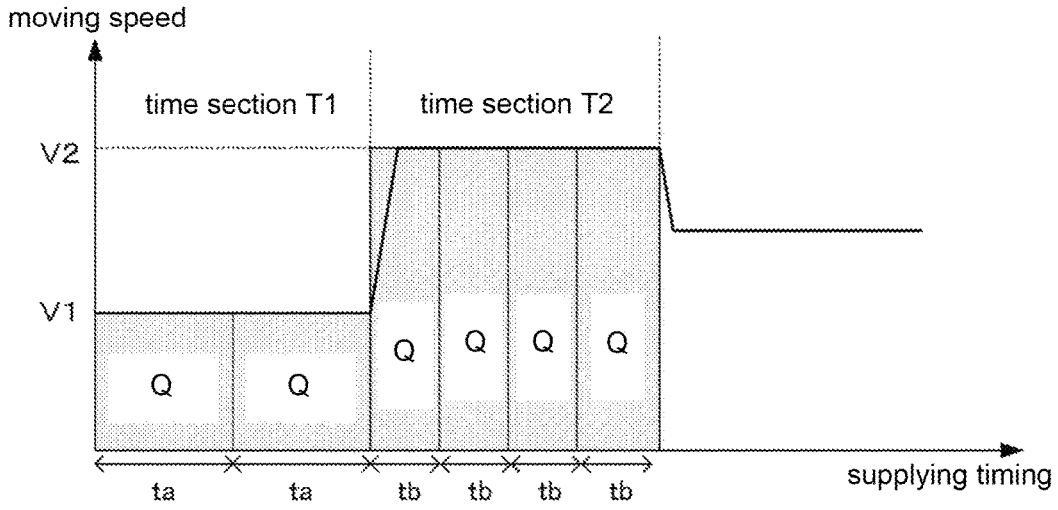
FIG. 14 is a graph showing a change of the moving speed of a fabric 100 and a change of the timing of supplying the lower thread.

FIG. 14 is a graph showing a change of the moving speed of the fabric 100 and a change of the timing of supplying the lower thread. As shown in FIG. 14, the fabric 100 is fed at a speed V1 in a time section T1, and the fabric 100 is fed at a speed V2 in a time section T2. In addition, the lower thread feeder 8 supplies the predetermined amount Q of the lower thread 300 for each driving operation.

In the time section T1, the cloth movement detection unit 22 detects the actual movement of the fabric 100 and the calculator 91*a* detects the actual moving speed V1 of the fabric 100. In the time section T1, the predetermined amount Q of the lower thread 300 is supplied in the time section t shown as t=Q/V1. In other words, the controller 91*b* transmits the driving signal to the stepping motor 88 in the time section t shown as t=Q/V1 to drive the lower thread feeder 8 in a time section to shown as t=Q/V1.

In the time section T2, the cloth movement detection unit 22 detects the actual movement of the fabric 100 and the calculator 91*a* detects that the moving speed is changed to the actual moving speed V2 of the fabric 100. In the time section T2, the predetermined amount Q of the lower thread 300 is supplied in the time section t shown as t=Q/V2. In other words, the controller 91*b* transmits the driving signal to the stepping motor 88 in the time section t shown as t=Q/V2 to drive the lower thread feeder 8 in a time section tb shown as t=Q/V2.

Namely, the sewing machine 1 calculates the timing of lacking the lower thread 300 based on the actual moving speed of the fabric 100 and supplies the lower thread 300 at an appropriate timing. Accordingly, even when the user causes sudden change in cloth feed, the lower thread 300 is prevented from being supplied insufficiently and excessively. Thus, the stitches are prevented from being exposed on the top surface or the bottom surface of the fabric 100.

(Another Example of Controlling the Lower Thread Feeder)

Figure 15:
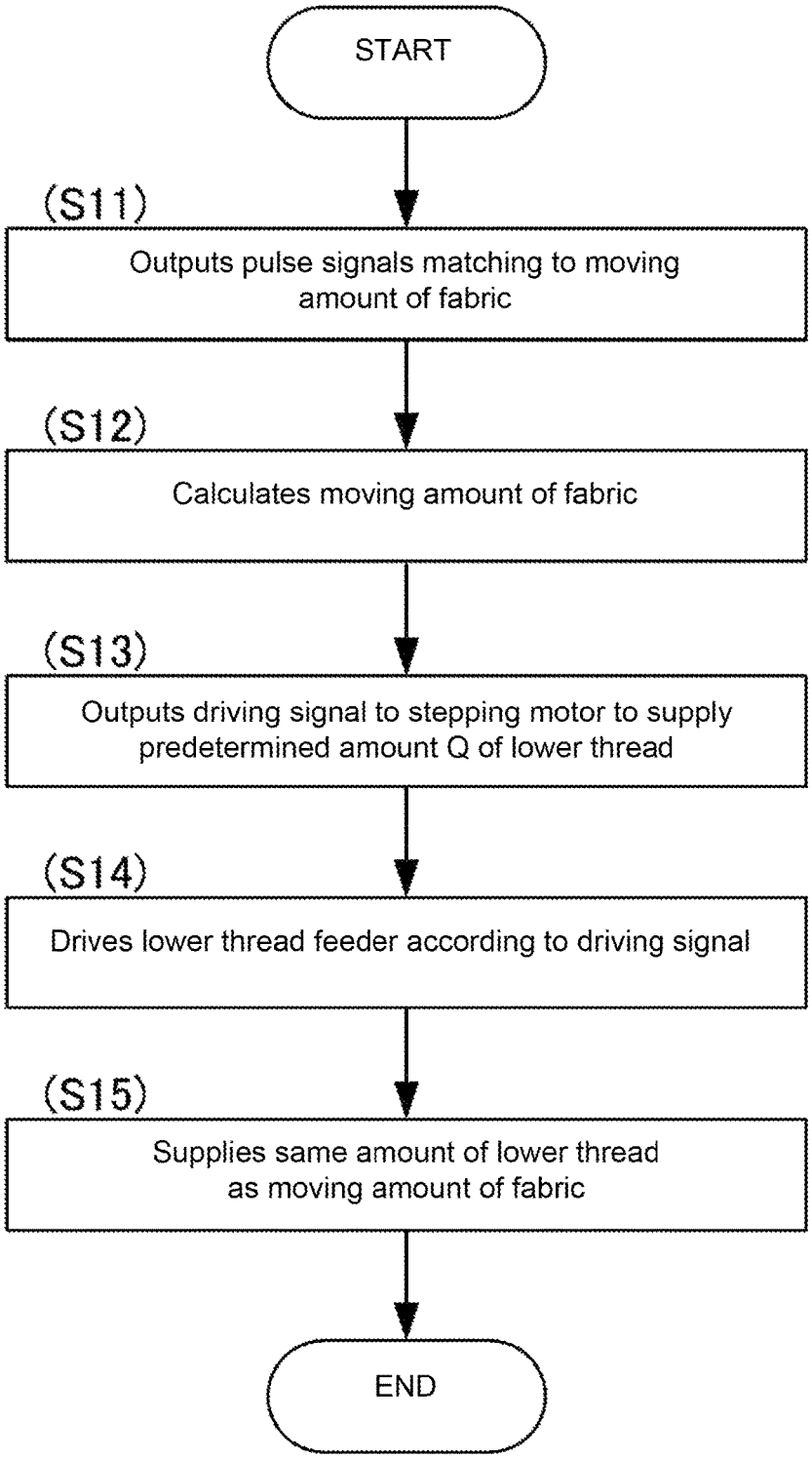
FIG. 15 is a flowchart showing the second control operation of the lower thread feeder.

Another example of controlling the lower thread feeder 8 by the controller 91*b* will be explained. FIG. 15 is a flowchart showing the second control operation of the lower thread feeder. As shown in FIG. 15, when the spherical body 22*a* is rotated, the grid disc 22*e* which is in contact with the spherical body 22*a* is also rotated. Accordingly, the rotary encoder 22*c* and the rotary encoder 22*d* output pulse signals to the calculator 91*a*, the pulse signals having the number of pulses matching to the moving amount of the fabric 100 (step S11). The calculator 91*a* calculates the moving amount of the fabric 100 from the input pulse signals (step S12).

After the moving amount of the fabric 100 is calculated, the controller 91*b* outputs the driving signal to the stepping motor 88 to control the lower thread feeder 8 so that the same amount of the lower thread 300 as the moving amount of the fabric 100 is supplied (step S13). The stepping motor 88 drives the lower thread feeder 8 according to the driving signal (step S14). The lower thread feeder 8 supplies the same amount of the lower thread 300 as the moving amount of the fabric 100 (step S15).

(Effects)

As explained above, in the sewing machine 1, the spherical body 22*a* is exposed partly from the needle plate 2, the spherical body 22*a* is rotated following the feed of the fabric 100, the rotary encoders 22*c*, 22*d* detect the rotation of the spherical body 22*a*, and the physical amount of the movement of the fabric 100 is calculated based on the detection result of the rotary encoders 22*c*, 22*d*. The physical amount of the movement of the fabric 100 is the moving amount and the moving speed, for example.

Accordingly, a physical amount of the movement of the fabric 100 can be actuary detected without depending on the estimated value, and the supplying amount and the supplying timing of the lower thread 300 can be controlled according to the actual amount. Thus, with respect to the thread tension, quality and reliability of the sewing of the fabric 100 can be increased. For example, the lower thread 300 can be supplied without excess or deficiency. Thus, the thread tension is prevented from being irregular with respect to the actual moving amount of the fabric 100 and being deteriorated in the quality of the stitches.

In the sewing machine 1, the spherical body 22*a* is mounted on a position to be covered by the fabric 100. Accordingly, the rotation of the spherical body 22*a* can follow the feed of the fabric 100 by the friction between the spherical body 22*a* and the fabric 100. Furthermore, the spherical body 22*a* is mounted on a position where the hand of the user is placed. Accordingly, the contact pressure of the fabric 100 with respect to the spherical body 22*a* can be increased. Even if the fabric 100 is light weight, the spherical body 22*a* follows the movement of the fabric 100 precisely.

If the spherical body 22*a* is mounted on the position where the hand of the user is placed, the spherical body 22*a* can be rotated by the hand of the user in accordance with the movement of the fabric 100. By doing so, even when the spherical body 22*a* is inevitably exposed in case of sewing the end of the fabric 100, for example, the spherical body 22*a* can be rotated following the feed of the fabric 100.

As long as the spherical body 22*a* is located near the needle location point, the spherical body 22*a* can be installed on a straight line passing through a needle location point and extending in the moving direction of the feed dog 21. Accordingly, the physical amount of the movement of the fabric 100 can be detected precisely at the needle location point. Therefore, the supplying amount and the supplying timing of the upper thread 200 and the lower thread 300, which are greatly influenced by the movement of the fabric 100, can be controlled precisely. Thus, the fabric 100 can be sewn more precisely.

The rotary encoders 22*c*, 22*d* detect the rotation of the spherical body 22*a* by two axes corresponding to two oblique directions along the surface of placing the fabric 100. For example, the two axes can be the feed direction of the fabric 100 fed by the feed dog 21 and the orthogonal direction of the feed direction. Ideally, the fabric 100 is fed only in the feed direction fed by the feed dog 21. However, a component orthogonal to the feed direction is also generated by crease of the fabric 100, friction of the material and other reasons. In the sewing machine 1, the orthogonal component is also considered. Thus, the actual physical amount of the movement of the fabric 100 can be detected precisely. Accordingly, the fabric 100 can be sewn more precisely.

Furthermore, the stepping motor 88 is provided separated with the sewing machine motor 6 which drives the thread take-up lever 7, the needle bar 31 and the rotary shuttle 5 in interlock with each other. The lower thread feeder 8 is driven by receiving the driving force from the stepping motor 88. Thus, the timing and supplying amount of the lower thread 300 of the lower thread feeder 8 are controlled by the controller 91*b*. Accordingly, the calculator 91*a* can calculate the physical amount of the movement of the fabric 100, and the controller 91*b* can control the supplying amount, the supplying timing and the number of supplying of the lower thread 300 supplied by the lower thread feeder 8 based on the physical amount of the movement of the fabric 100.

For example, the calculator 91*a* calculates the moving speed of the fabric 100. The controller 91*b* controls the supplying timing of the lower thread 300 supplied by the lower thread feeder 8 based on the moving speed of the fabric 100. Thus, the timing of requiring the supply of the lower thread 300 can be estimated from the moving speed of the fabric 100. Accordingly, the lower thread 300 can be supplied without excess or deficiency at an appropriate timing. Therefore, the fabric 100 can be sewn more precisely. In particular, the moving speed of the fabric 100 is frequently changed and sometimes quickly changed in the free motion mode. Also in such a case, the lower thread 300 can be easily supplied without excess or deficiency.

OTHER EMBODIMENTS

Although the embodiments of the present invention are explained above, various omissions, replacements and changes are possible within a range being not deviated from the subject-matter of an invention.

The embodiments and variation examples are included in the scope and the subject-matter of the present invention, and included in the invention described in the claims and equivalents.

In addition to the detection result of the cloth movement detection unit 22, the computer 9 can detect values of the encoder of the sewing machine motor 6, detection result and operation result of various sensors so as to control the lower thread feeder 8 according to various status of the sewing including the actual movement of the fabric. Furthermore, in addition to the supplying amount and supplying timing of the lower thread 300, the supplying amount and the supplying timing of the upper thread 200 can be also controlled.

In the above described embodiments, the spherical body and the encoder are used as a sensor for calculating the physical amount of the movement of the fabric. However, an optical sensor can be used instead of the spherical body, similar to a mouse used as an operation devise of the computer. In such a case, a laser light and a blue LED are preferably used for the optical sensor to detect the movement of the fabric. The optical sensor is provided on the same position as the exposed position of the spherical body so that the optical sensor is directed upward, and the calculator calculates the physical amount of the movement of the fabric based on the detection result of the optical sensor.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A sewing machine for forming stitches on a fabric by passing a needle through the fabric to interlace an upper thread and a lower thread with each other, comprising:

a needle plate on which the fabric is placed;

a spherical body that is exposed partly from the needle plate, the spherical body being rotated by a friction force applied between the fabric and the spherical body;

an encoder that detects a rotation of the spherical body;

a calculator that calculates a physical amount of a movement of the fabric based on a detection result of the encoder;

a first motor;

an upper shaft that is rotated by the first motor;

a lower shaft that is rotated in conjunction with the upper shaft;

a thread take-up lever that receives a driving force from the first motor via the upper shaft;

a needle bar that receives the driving force from the first motor via the upper shaft;

a rotary shuttle that receives the driving force from the first motor via the lower shaft;

a second motor that is different from the first motor;

a lower thread feeder that is driven by receiving a driving force from the second motor to supply the lower thread according to a timing and an amount of driving the second motor; and a controller that drives the second motor based on the physical amount of the movement of the fabric to control a timing and an amount of supplying the lower thread of the lower thread feeder, wherein the lower thread feeder and the thread take-up lever are separately controlled.

2. The sewing machine according to claim 1, wherein the calculator calculates a moving amount or a moving speed of the fabric, and the controller controls the amount or the timing of supplying the lower thread supplied by the lower thread feeder based on the moving amount or the moving speed of the fabric.

3. The sewing machine according to claim 2, wherein the calculator calculates the moving speed of the fabric, and the controller controls the timing of supplying the lower thread supplied by the lower thread feeder based on the moving speed of the fabric.

4. The sewing machine according to claim 1, wherein the spherical body is formed at a position of a hand of a user of pressing the fabric.

5. The sewing machine according to claim 1, further comprising:

a feed dog that appears from the needle plate to feed the fabric in one direction; wherein the spherical body is installed on a straight line, the straight line passing through a needle location point of the needle and extending in a feed direction of the fabric fed by the feed dog.

6. The sewing machine according to claim 1, wherein the encoder detects the rotation of the spherical body by two axes corresponding to two oblique directions along a surface of placing the fabric.

7. The sewing machine according to claim 1, further comprising:

a controller that controls a lower thread feeder based on the physical amount.

* * * * *